US007651350B1

(12) United States Patent
Wu

(10) Patent No.: US 7,651,350 B1
(45) Date of Patent: Jan. 26, 2010

(54) CABLE ASSEMBLY ADAPTED FOR MOUNTING TO PANEL

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/454,073

(22) Filed: May 12, 2009

Related U.S. Application Data

(63) Continuation-in-part of application No. 12/231,639, filed on Sep. 3, 2008, now Pat. No. 7,572,144.

(51) Int. Cl.
*H01R 13/62* (2006.01)

(52) U.S. Cl. ..... 439/153; 439/545

(58) Field of Classification Search ..... 439/544, 439/545, 553–559, 247, 153
See application file for complete search history.

(56) References Cited

U.S. PATENT DOCUMENTS 5,199,900 A * 4/1993 Hayes, Sr. ..... 439/557
5,800,208 A * 9/1998 Ishizuka et al. ..... 439/557
6,579,111 B2 * 6/2003 Fukamachi ..... 439/557
6,916,197 B1 * 7/2005 Wu ..... 439/484
7,192,307 B1 * 3/2007 Tran et al. ..... 439/553
7,281,938 B1 * 10/2007 Wu ..... 439/353
7,364,465 B2 * 4/2008 Wu ..... 439/607.55
2005/0233631 A1 * 10/2005 Wu ..... 439/352

FOREIGN PATENT DOCUMENTS

CN 2762206 3/2006

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

A cable assembly includes an insulative housing (1) including a mating portion (12), a mounting portion (13) extending rearward from the mating portion and a base portion connected to the mounting portion. A lock tab (132) is formed on the mating portion and disposed adjacent to the mounting portion. A plurality of contacts (21, 22) received in the insulated housing and connected to wires (102). A retaining member (15) is connected to the base portion of the insulative housing, said retaining member having a passageway extending along a longitudinal direction. A sliding member (5) accommodated in the passageway of the retaining member and capable of moving along therein. A spring member (6) is received in the passageway of the retaining member for pushing the sliding member sliding along the longitudinal direction to reach a lateral side of the mounting portion; and a pulling tape (7) attached to the sliding member (5) for pulling the sliding member away from the lateral side of the mounting portion.

19 Claims, 8 Drawing Sheets

CABLE ASSEMBLY ADAPTED FOR MOUNTING TO PANEL

CROSS-REFERENCE TO RELATED APPLICATION

This application is a continuation-in-part (CIP) of U.S. patent application Ser. No. 12/231,639, filed on Sep. 3, 2008 now U.S. Pat. No. 7,572,144 and entitled "CONNECTOR ADAPTED FOR MOUNTING TO PANEL", which has the same assignee as the present invention.

FIELD OF THE INVENTION

The present invention generally relates to a cable assembly, and more particularly to a cable assembly adapted to be mounted to a panel of an electronic device.

DESCRIPTION OF PRIOR ART

A cable assembly is widely applied in an electronic devices, such a computer, sever, etc. A typical cable assembly is mounted to a panel of the electrical device and connected to a cable which is further linked other component inside of the electrical devices, serving as an intermediate member bridging the electronic device and other exterior electronic device.

For example, CN Pat. No. 2762206 discloses a similar cable assembly attached to a panel of an electronic device, including a connector, a number of conductive wires connected to the connector and further connected to other electronic components, and additional bolts and nuts applied to fasten the connector and the panel together. However, as the dimension of the electronic device become more and more low profile, and any components thereof have to reduce its dimension accordingly, including the bolts and nuts. Thus it is difficult for a user to manually operate the nuts and bolts to fasten the cable assembly to the panel, and tools, such as a screwdriver and a pincers are needed to turn the bolts and hold the nuts. Accordingly, the tools are required to operate the nuts and the bolts to demount (detach) the cable assembly from the panel.

Hence, an improved cable assembly is required to overcome aforementioned inconvenience.

SUMMARY OF THE INVENTION

Accordingly, an object of the present invention is to provide a cable assembly which is easily mounted to or demounted from a panel.

In order to achieve the object set forth, a cable assembly in accordance with the present invention comprises an insulative housing including a mating portion, a mounting portion extending rearward from the mating portion and a base portion connected to the mounting portion. A lock tab is formed on the mating portion and disposed adjacent to the mounting portion. A plurality of contacts are received in the insulated housing and connected to wires. A retainer member is connected to the base portion of the insulative housing, said retainer member having a passageway extending along a longitudinal direction. A slider member is accommodated in the passageway of the retainer member and capable of moving along therein. A spring member is received in the passageway of the retainer member for pushing the slider member sliding along the longitudinal direction to reach a lateral side of the mounting portion. A pulling tape attached to the slider member for pulling the slider member away from the lateral side of the mounting portion.

Other objects, advantages and novel features of the invention will become more apparent from the following detailed description when taken in conjunction with the accompanying drawings.

DETAILED DESCRIPTION OF PREFERRED EMBODIMENTS

Figure 1:
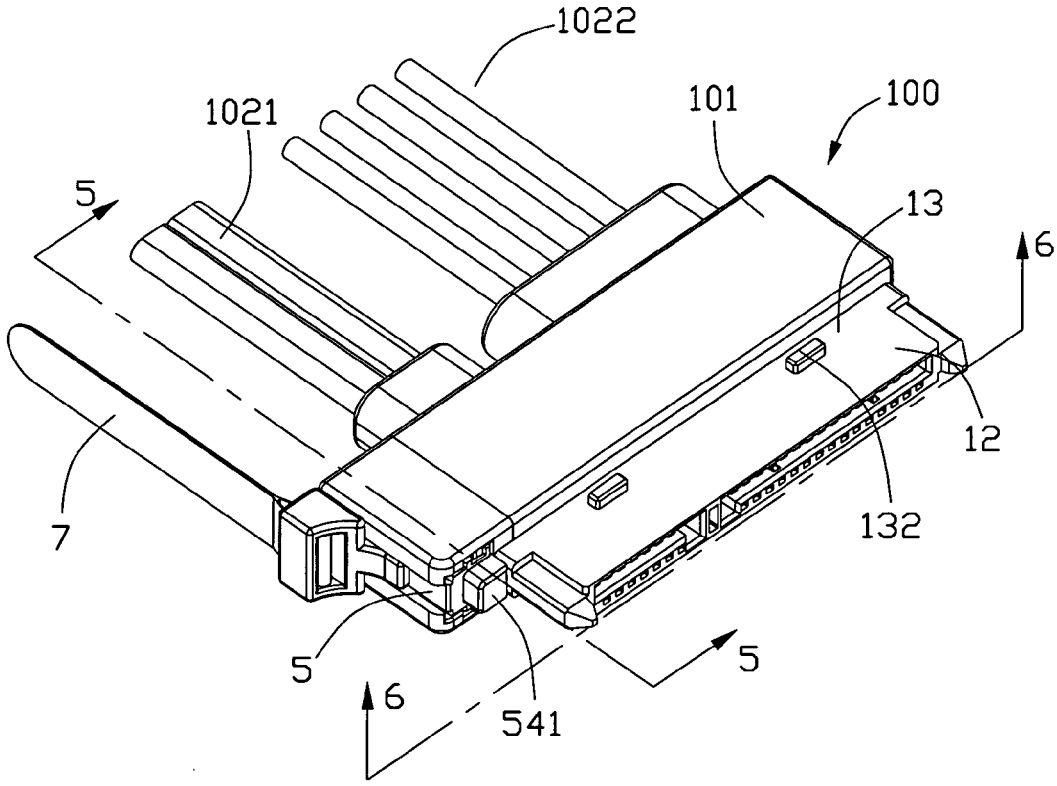
FIG. 1 is an assembled, perspective view of a cable assembly in accordance with the present invention.
Figure 2:
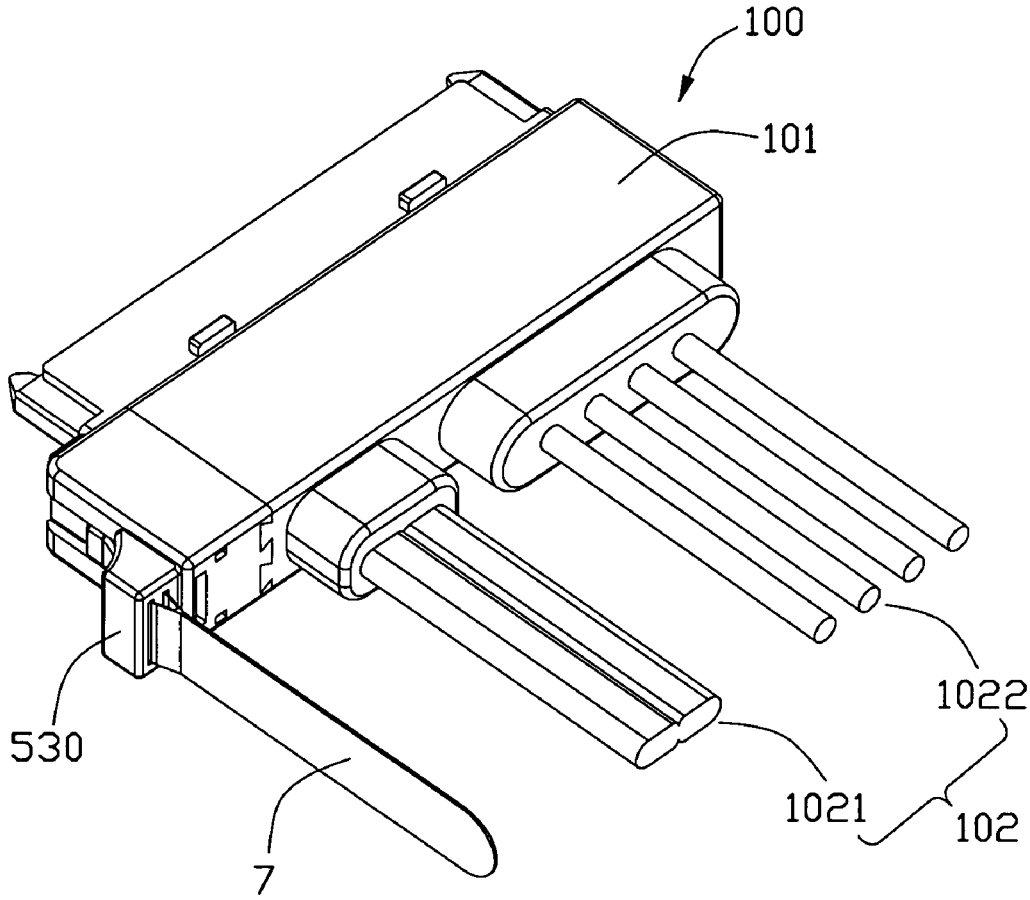
FIG. 2 is similar to FIG. 1, but viewed from other aspect.
Figure 3:
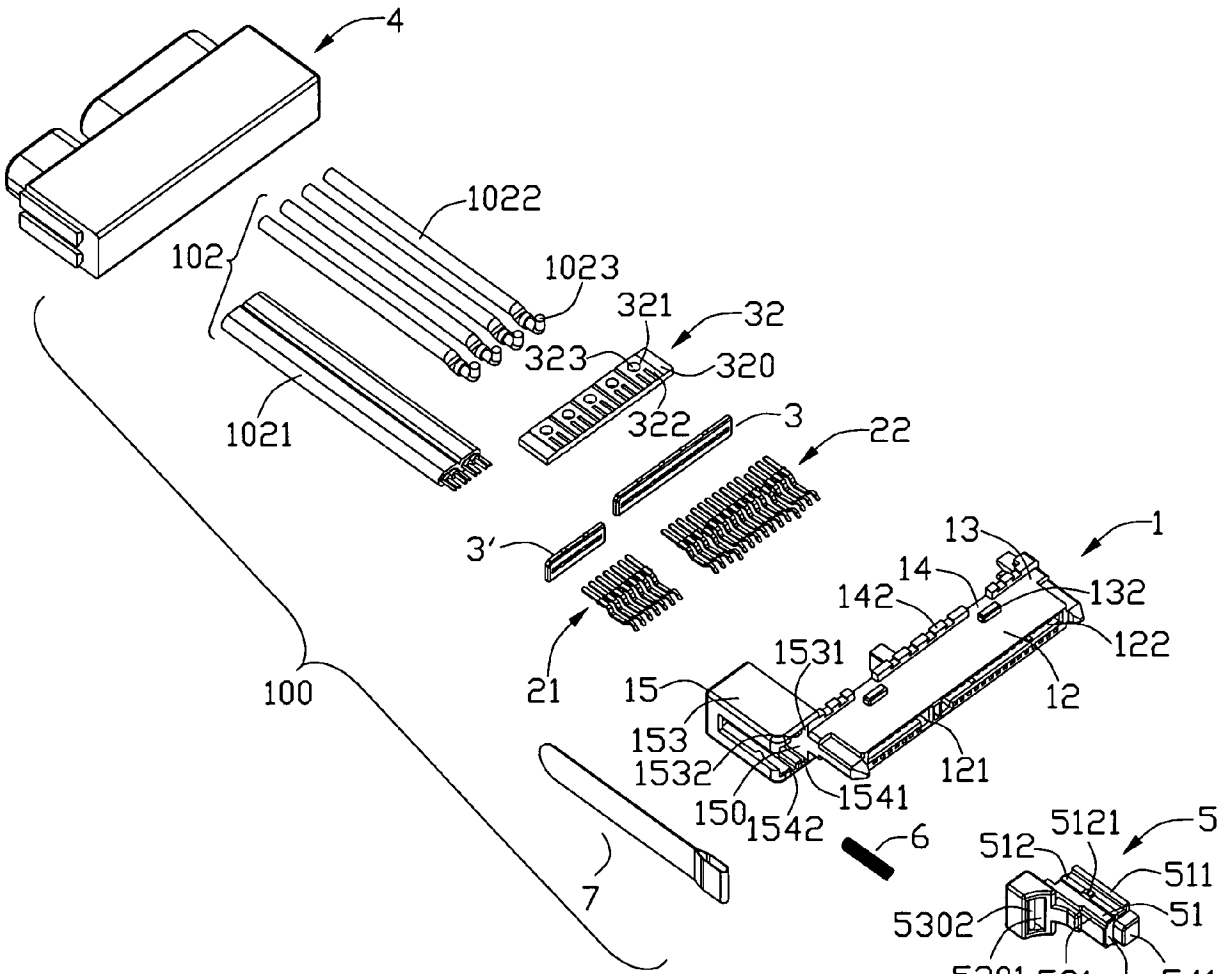
FIG. 3 is an exploded, perspective view of the connector.
Figure 4:
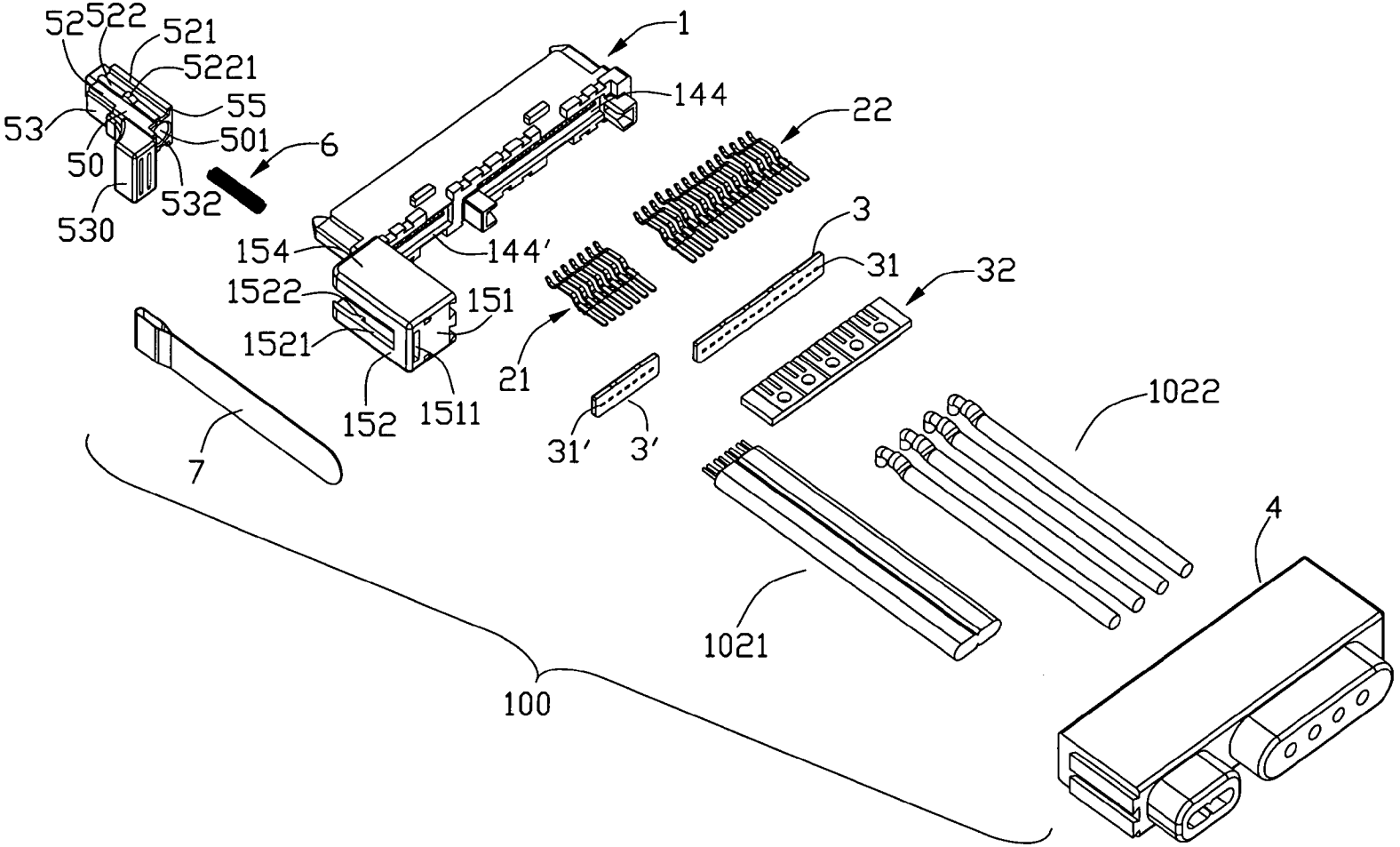
FIG. 4 is similar to FIG. 3, but viewed from other aspect.
Figure 5:
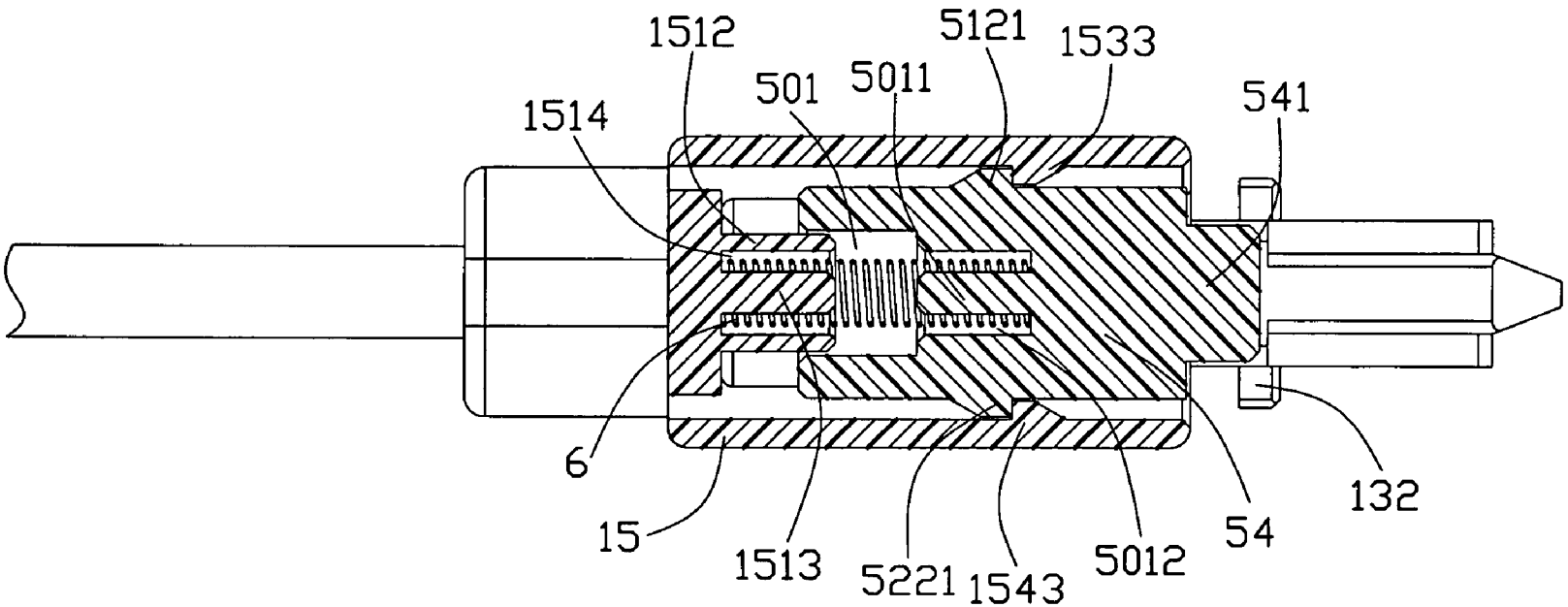
FIG. 5 is a cross-section view of FIG. 2 taken along line 5-5.
Figure 6:
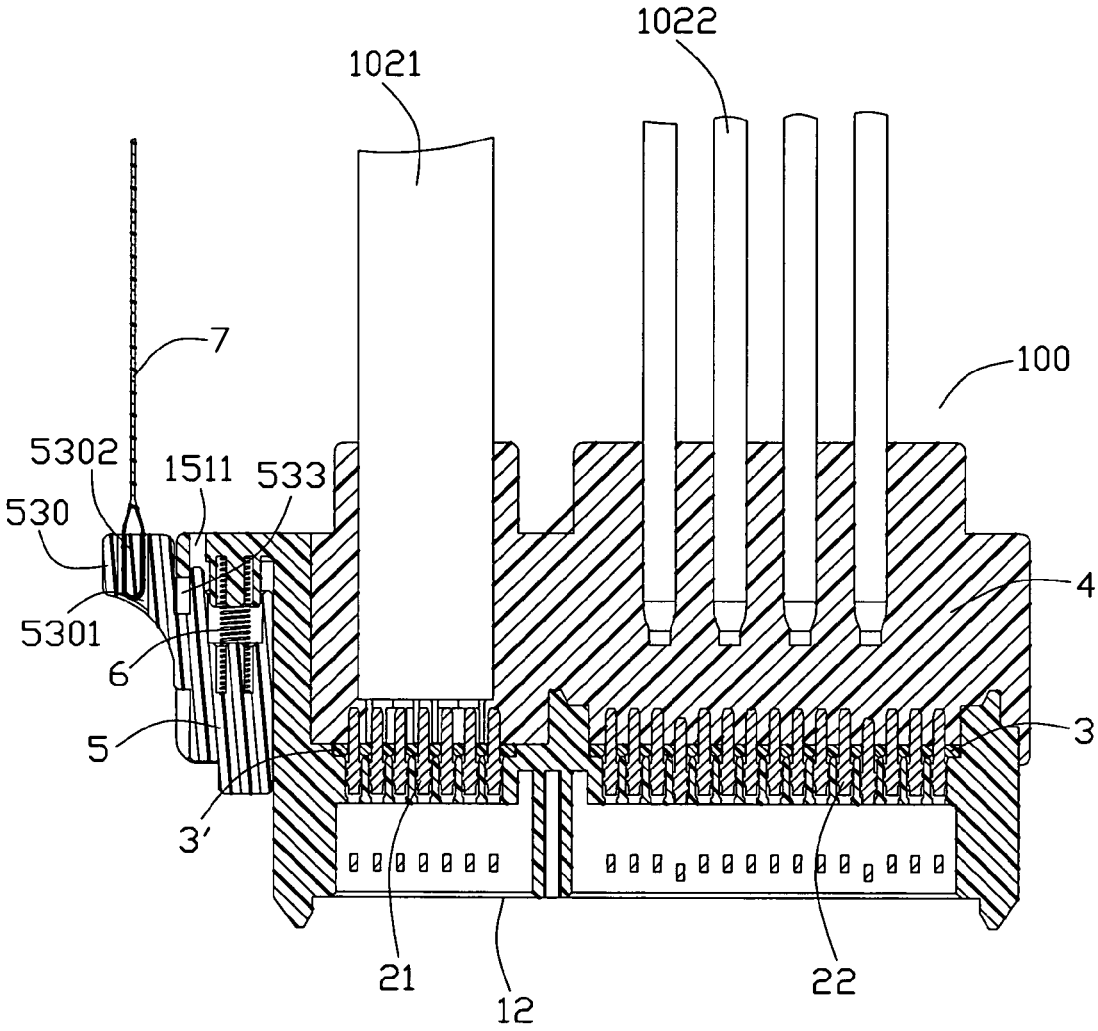
FIG. 6 is a cross-section view of FIG. 1 taken along line 6-6.

Reference will now be made in detail to the preferred embodiment of the present invention.

Referring to FIGS. 1-6, a cable assembly 100 in accordance with the present invention comprises connector 101 and a plurality of wires 102 connected thereto.

The connector 101 includes an insulative housing 1, a plurality of contacts 2 received in the insulated housing and connected to wires 102. A retaining member 15 is connected to the insulative housing 1. A sliding member 5 is accommodated in the retaining member 15 and capable of moving along therein. A spring member 6 is received in the retaining member 15 for biasing the sliding member 5. A pulling tape 7 is attached to the sliding member 5.

The insulative housing 1 has an elongated mating portion 12 which is configured by a number of walls (not numbered) interconnected together to form two mating ports 121, 122, a mounting portion 13 connected to a rear face (not shown) of the mating portion 12 and a base portion 14 extending rearward from a back face of the mounting portion 13. Two pair of locking tabs 132 are formed at rear sections of a top and a bottom surfaces of the mating portion 12 and disposed in front of the mounting portion 13. A number of protruding members 142 are respectively located on top and bottom surfaces of the base portion 14. Two elongated cavities 144, 144' are recessed forwardly from a back surface of the base portion 14 for receiving the spacing members 3 and 3' therein.

The retaining member 15 is connected to a lateral side of the base portion 14 and extends beyond the back surface of the base portion 14. The retaining member 15 defines a passageway 150 extending along a longitudinal direction which is perpendicular to the transversal direction. The passageway 150 has a front outlet, a rectangular-shaped hole 1511 defined in a rear wall 151 of the retaining member 15, and a slit 1521 defined in a lateral wall 152 thereof. Both the hole 1511 and the slit 1521 are in communication to the passageway 150. A pair of first protrusions 1522 are formed on a lower and upper sections of an inner surface of the lateral wall 152. A first channel portion 1531 and a second channel portion 1532 are arranged in juxtaposed manner and defined in an inner side of an upper wall 153 and extend along a longitudinal direction, and a bottom wall 154 also has a first channel portion 1541 and a second channel portion 1542 similar to and aligning with the first and second channel portions 1531, 1532 in the upper wall 153. A pair of first protruding members 1533, 1543 are respectively formed in front segments of the second channel portions 1532, 1542.

A cylindrical-shaped aligning member 1512 is formed on an inner surface of the rear wall 151 and extends forwardly along the longitudinal direction. Furthermore, a positioning post 1513 disposed inside of the aligning member 1512 and extends forwardly from the inner surface of the rear wall 151. The positioning post 1513 and the aligning member 1512 are arranged in coaxial relationship and parallel to one another. A loop-shaped gap/slot 1514 is formed between the positioning post 1513 and the aligning member 1512. However, it should be noted that the aligning member 1512 and the positioning post 1513 can be other shapes, such as rectangular, ellipse, and the like.

The contacts 2 includes a plurality of signal contacts 21 and power contacts 22 which are arranged into two distinct rows along the transversal direction. The signal contacts 21 and the power contacts 22 are supported by the insulative housing 1, with mating segments (not numbered) thereof extending into the mating ports 121, 122, and tail portions (not numbered) extending rearward to surpass the back surface of the insulated housing 1 and further passing through holes 31, 31' of spacer members 3, 3'.

A printed circuit board (PCB) 32 may be adopted to serve as a mediate for interconnecting the power contacts 22 and the power wires 1023. The PCB 32 includes a substrate 320, a number of conductive pads 321 located on the substrate 320. A front segment of each conductive pads 321 is divided into three finger portions 322, and the rear segment of the corresponding conductive pad 321 is punched with a hole 323 thereon.

The signal wires 1021 are soldered to the tail portions of the signal contacts 21. A front segments 1023 of the power wires 1022 are positioned into the holes 323 of the conductive pads 321 and further soldered therein while the tail portions of the power contacts 22 are soldered to the finger portions 322 of the conductive pads 321.

The sliding member 5 has a main portion 50 and a handle 530 formed on a back section of a lateral side 53 thereof. Two first guiding members 511, 521 and another two second guiding members 512, 522 are respectively formed on a top and a bottom surface 51, 52 of the main portion 50. Both the first guiding members 511, 521 and second guiding members 512, 522 are capable of sliding/moving along the first channel portions 1531, 1541 and the second channel portions 1532, 1542. A pair of second protruding members 5121, 5221 are formed on the second guiding members 512, 522. The second protruding members 5121, 5221 can be blocked/stopped by the first protruding members 1533, 1543 to prevent the sliding member 5 sliding/escaping away the retaining member 15. A pair of notches 531 are respectively defined in an upper and a lower sections of the lateral side 53 and arranged in the front segment thereof. The pair of first protrusions 1522 are capable of moving along the notches 531 and stopped at ends thereof.

A tab 532 extends rearward from the a back surface 55 of the main portion 50. A gap 533 is formed between the tab 532 and the handle 530. A circular-shaped slot 501 is recessed forwardly from the back surface 55 of the main portion 50. A positioning pole 5011 is disposed in a front segment of the slot 501 and extends rearward from an inner surface of a front wall 54 of the main portion 50, thus a loop-shaped hollow portion 5012 is formed between the positioning pole 5011 and an inner surface of the front segment of the slot 501. A head portion or front end portion 541 is formed on a front surface of the front wall 54. The cover 4 is made of insulative material, such as plastic etc. which is molded over the base portion 14 and front segments of the cables 102 so as to have the contacts 2 and signal wires 1021 and power wires 1022 coupled together securely. The protrusion members 142 of the base portion 14 may enhance combination between the base portion 14 and the cover 4.

A slot 5301 is defined in the handle 530, and a mounting portion 5302 is disposed in the slot 5301. The pulling tape 7 is tied/fastened to the mounting portion 5302. However, in alternative embodiment, the pulling tape 7 may attached to/fastened to the main portion 50 of the sliding member 5.

The sliding member 5 is assembled to and held by the retaining member 15, with main portion 50 received in the passageway 150, the handle 530 disposed outward of the lateral wall 152 and capable of moving along the slit 1521. Furthermore, the positioning pole 5011 and the positioning post 1513 are inserted into a front segment and a rear segment of an internal of the spring member 6. The spring member 6 can push the sliding member 6 forward to move forwardly to have header portion 541 exposed outward of a front surface of the retaining member 15 and located at a lateral side of the mounting portion 13. When a force is exerted onto the pulling tape 7 to rearwardly pull the handle 530, the aligning member 1512 slides into a front segment of the slot 501, and the spring member 6 is compressed and the header portion 541 of sliding member 5 retracts into the passageway 150.

Figure 7:
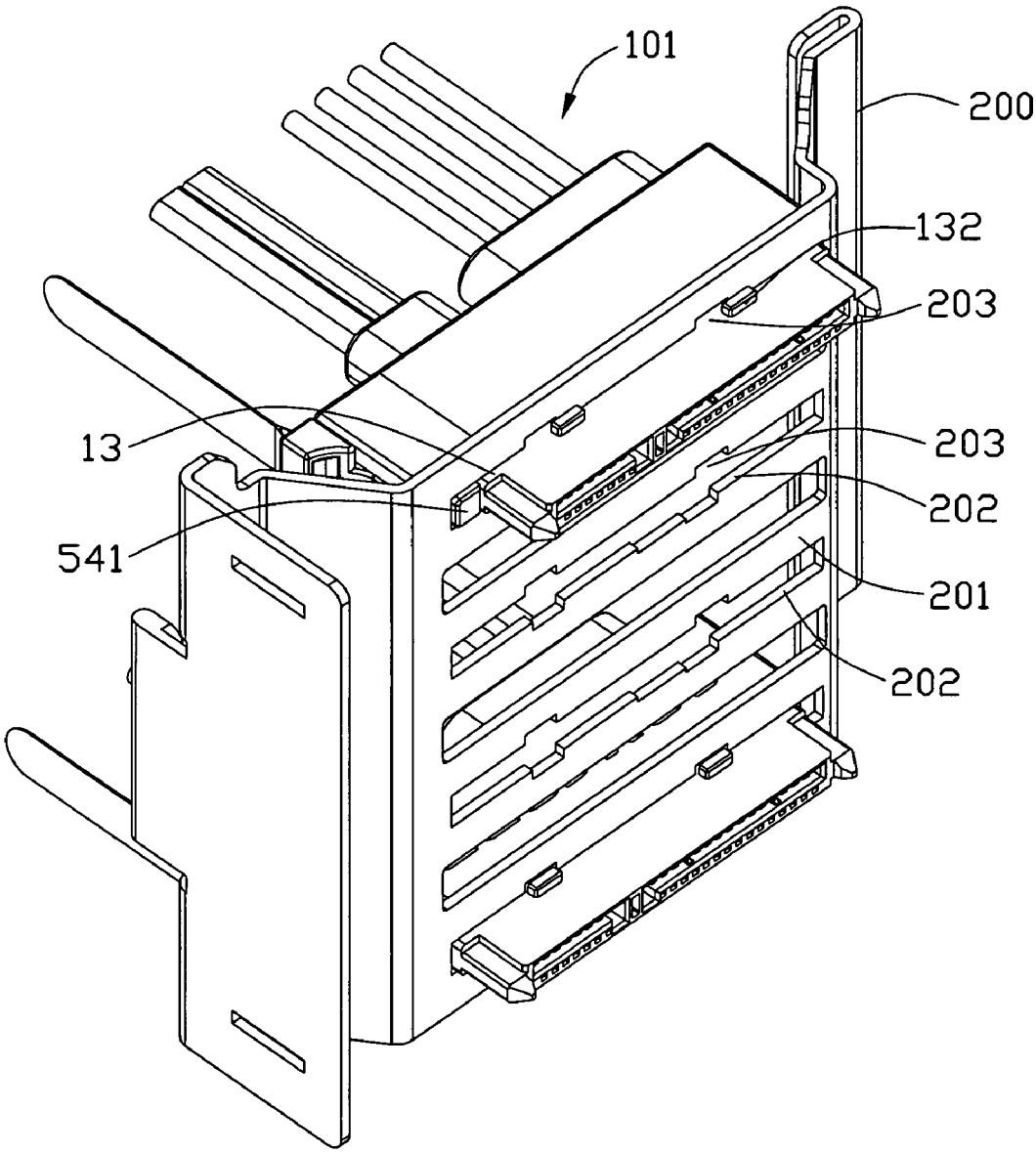
FIG. 7 shows the connector being mounted to a panel.
Figure 8:
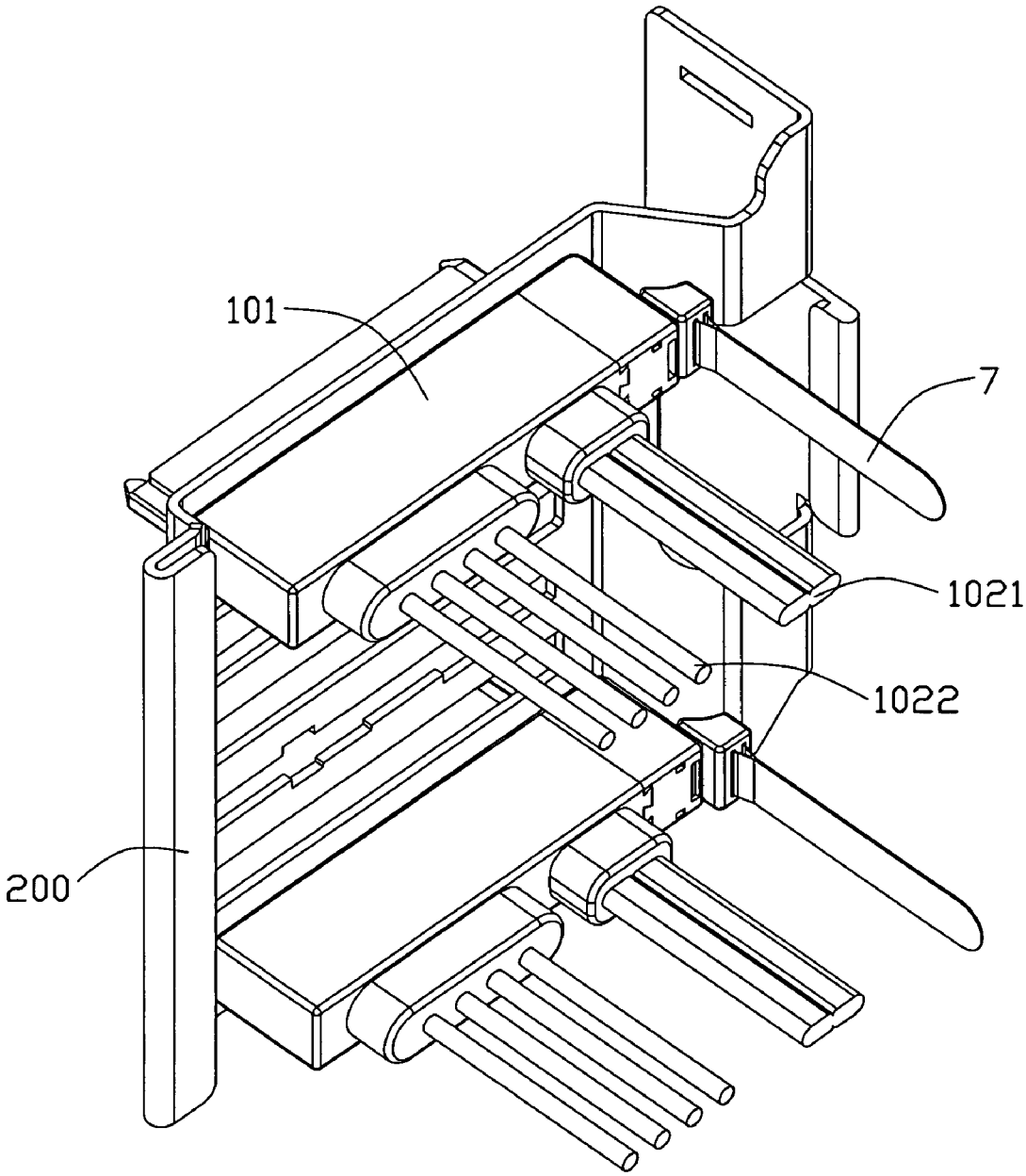
FIG. 8 is similar to FIG. 7, but viewed from other aspect.

Referring to FIGS. 7-8 and in conjunction with FIGS. 1-6, a panel 200 includes a body portion 201, a number of elongated openings 202 defined in the body portion 201. The elongated openings 202 are parallel to each other. A number of cutouts or apertures 203 disposed along and in communication to each of the corresponding elongated openings 202. When the cable assembly 101 is mounted to the panel 200, the mating portion 12 is firstly inserted into the opening 202 and the head portion 541 is pushed backwardly by the panel 200 or pulled back by the pulling tape 7, then the locking tabs 132 pass through the cutout 203. Secondly, the connector 101 is moved along the transversal direction, and the header portion 541 extends into the opening 202 automatically by resilient force of the spring member 6, thus the mounting portion 13 and the header portion 541 are both accommodated in the opening 202 to inhibit or limit the mounting portion 13 movement along the opening within a certain range such that the lock tabs 132 can't exit out of the opening 202 arbitrarily, therefore the lock tabs 132 and the cover 4 and the retaining member 15 arranged at opposite sides of the panel 200 such that the connector 101 is securely attached to the panel 200. When the connector 101 is to be detached from the panel 200, a force is exerted to the pulling tape 7 to rearwardly pull the sliding member 5 to have header portion 541 to retract into the passageway 150, and the connector 101 is laterally moved to have the lock tabs 132 exit through cutouts 203.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly adapted for mounting to a panel, comprising:

an insulative housing including a mating portion, a mounting portion extending rearward from the mating portion and a base portion connected to the mounting portion, a locking tab formed on the mating portion and disposed adjacent to the mounting portion;

a plurality of contacts received in the insulative housing and connected to wires;

a retaining member connected to the base portion of the insulative housing, said retaining member having a passageway extending along a longitudinal direction;

a sliding member accommodated in the passageway of the retaining member and capable of moving along therein;

a spring member received in the passageway of the retaining member for pushing the sliding member to slide along the longitudinal direction to reach a lateral side of the mounting portion; and a pulling tape attached to the sliding member for pulling the sliding member away from the lateral side of the mounting portion.

2. The cable assembly as recited in claim 1, wherein the sliding member includes a guiding member on a top or a bottom surfaces thereof, and a corresponding channel portion is defined in an inner portion of an upper or a bottom walls of the retaining member to receive the guiding member.

3. The cable assembly as recited in claim 2, wherein a first protruding member is formed on the guiding member and a second protruding member is arranged in the corresponding channel portion to block the first protruding member.

4. The cable assembly as recited in claim 1, wherein a notch portion defined in a front segment of a lateral side of the sliding member, and a corresponding protruding is formed on an inner surface of the lateral side of the retaining member and capable of sliding along the notch portion.

5. The cable assembly as recited in claim 1, wherein an aligning member is disposed in the passageway and formed on an inner surface of a rear wall of the retaining member, and a slot is recessed forwardly from a back surface of the main portion of the sliding member for receiving the aligning member.

6. The cable assembly as recited in claim 5, wherein a positioning pole is disposed in a front segment of the slot and extends rearward from an inner surface of a front wall of the sliding member, and positioning post is disposed inside the aligning member and extends forwardly from the rear wall of the retaining, wherein the positioning pole and the positioning post respectively are inserted into the spring member from opposite sides.

7. The cable assembly as recited in claim 1, wherein a protruding member is formed on the base portion, and a cover is molded over the base portion to have the protruding member enclosed therein.

8. The cable assembly as recited in claim 1, wherein an elongated cavity is recessed forwardly from a back surface of the base portion to receive a spacing member.

9. The cable assembly as recited in claim 1, wherein a slit is defined in a lateral side of the retaining member and in communication to the passageway.

10. The cable assembly as recited in claim 9, wherein the sliding member includes a main portion and a handle formed on a lateral side of the main portion, the main portion is accommodated in the passageway and the handle is disposed outside of the passageway and capable of moving along the slit.

11. The cable assembly as recited in claim 10, wherein the pulling tape is fastened to the handle of the sliding member.

12. The cable assembly as recited in claim 1, further comprising a printed circuit board with a number of conductive pads thereon connected to the contacts and the wires.

13. The cable assembly as recited in claim 12, wherein each of the conductive pads has three finger portions in the front segment thereof for soldering with tail portions of three of the contacts, and a back segment of the each of the conductive pads is soldered with one of the wires.

14. The cable assembly as recited in claim 13, wherein a front portion of the one of the wires is positioned in a corresponding hole defined in the each of the conductive pads.

15. The cable assembly as recited in claim 1, wherein the panel defines an opening and a cutout arranged along and in communication with the opening, the mounting portion of the insulative housing and a front end of the sliding member are received in the opening and the locking tab is disposed in front of the panel and offsets the cutout.

16. A cable assembly comprising:

a metallic panel defining at least one elongated mounting slot with at least one cutout along one edge of said mounting slot;

an electrical connector defining an elongated mounting portion located behind the panel, and an elongated mating potion extending forwardly from said mounting portion through the elongated mounting slot and exposed in front of the panel;

a locking tab formed on the mating portion and configured to be compliant with the cutout;

a retaining member located at one elongated end of the mounting portion and behind the panel;

a sliding member associated with the retaining member and urged forwardly by a spring member; and a pull tape discrete from while linked to the sliding member for moving rearward the sliding member by resisting a force from the spring; wherein the elongated slot receives both the mating portion and the sliding member under condition that the sliding member is located in a front position and the locking tab is offset from the corresponding cutout when said connector is located in a first lateral position with regard to the panel; the elongated slot receives only the mating portion under condition that the sliding member is located in a rear position and the locking tab is aligned with the corresponding cutout when said connector is located in a second lateral position with regard to the panel for allowing rearward withdrawal of the connector from the panel.

17. The cable assembly as claimed in claim 16, wherein the pull tape is connected to a portion of the sliding member which is located laterally outside of the retaining member.

18. The cable assembly as claimed in claim 16, wherein a plurality of cables extend rearwardly from the mounting portion, and said pull tape is laterally spaced from said cables via said retaining member.

19. The cable assembly as claimed in claim 16, wherein said pull tape defines a plane parallel to a lateral side of the retaining member.

* * * * *